US005082194A

United States Patent [19]

Grecksch et al.

[11] Patent Number: 5,082,194

[45] Date of Patent: Jan. 21, 1992

[54] METHOD AND APPARATUS FOR EVALUATING THE INTERRUPTION OF WINDING ON A TEXTILE WINDING MACHINE

[75] Inventors: Hans Grecksch; Dietmar Engelhardt; Gregor Rüth; Rolf Haasen, all of Mönchengladbach, Fed. Rep. of Germany

[73] Assignee: W. Schlafhorst AG & Co., Moenchengladbach, Fed. Rep. of Germany

[21] Appl. No.: 613,088

[22] Filed: Nov. 14, 1990

[30] Foreign Application Priority Data

Nov. 14, 1989 [DE] Fed. Rep. of Germany ..... 3937824
Oct. 15, 1990 [DE] Fed. Rep. of Germany ..... 4032617

[51] Int. Cl.[5] ..... B65H 54/22
[52] U.S. Cl. ..... 242/35.6 R; 242/36
[58] Field of Search ..... 242/35.6 R, 35.5 R, 242/36, 18 R, 37 R

[56] References Cited

U.S. PATENT DOCUMENTS

| | | | |
|---|---|---|---|
| 2,736,505 | 2/1956 | Furst et al. | 242/36 |
| 2,752,103 | 6/1956 | Furst | 242/36 |
| 3,539,122 | 11/1970 | Spani | 242/36 |
| 3,776,479 | 12/1973 | Lutovsky et al. | 242/35.6 R |
| 4,513,921 | 4/1985 | Imoda et al. | 242/36 |
| 4,544,107 | 10/1985 | Matsui et al. | 242/35.5 A |
| 4,773,606 | 9/1988 | Ohashi | 242/35.6 R |
| 4,911,372 | 3/1990 | Uchida et al. | 242/35.6 R |
| 4,986,482 | 1/1991 | Okayama | 242/35.6 R |
| 4,988,050 | 1/1991 | Tone | 242/35.6 R |

FOREIGN PATENT DOCUMENTS 459836 9/1968 Switzerland .

*Primary Examiner*—Stanley N. Gilreath
*Attorney, Agent, or Firm*—Shfte, Pinckney & Sawyer

[57] ABSTRACT

A method and apparatus for restoring the normal winding of yarn following a yarn break during a textile winding process is provided. A lower yarn end engaging member executes a predetermined number of attempts to engage a lower yarn end and a package exchange member exchanges a supply package for a fresh supply package in response to the detection of the absence of engagement of a lower yarn end after the predetermined number of lower yarn end engaging cycles. Once a lower yarn end is detected, an upper yarn end engaging means performs a predetermined number of attempts to engage an upper yarn end. If engagement of an upper yarn end is detected after a predetermined number of attempts, the lower yarn end and the upper yarn end are joined together and normal winding is resumed. If an upper yarn end is not detected after a predetermined number of attempts, a problem indicating member is activated to indicate to an operator that normal winding of yarn cannot be restored.

18 Claims, 6 Drawing Sheets

METHOD AND APPARATUS FOR EVALUATING THE INTERRUPTION OF WINDING ON A TEXTILE WINDING MACHINE

BACKGROUND OF THE INVENTION

The present invention relates to a method and apparatus for evaluating the interruption of the winding of yarn on a textile winding machine.

In the winding of yarn from a supply package onto a cross-wound package, the yarn drawn from the supply package typically travels through a slub catcher-type yarn clearer which monitors the occurrence of certain out-of-limit situations such as sections of the traveling yarn which have a cross-section that is too thin or too thick. Swiss Patent Document No. 459,836 discloses an apparatus for restoring the winding operation of a winding station of a textile winding machine following a break in the travel of yarn in any one of three different situations. In one instance, a break in the yarn may be intentionally implemented through the control of a yarn cutting device by the slub catcher. In this instance, the slub catcher controls the yarn cutting device to sever the yarn at a location between the section of the yarn having the out-of-limits condition (i.e., too thin or too thick) and the supply package.

In a second type of yarn break situation which the apparatus disclosed in the Swiss Patent Document is adapted to handle, a break in the yarn occurs between the slub catcher and the cross-wound package. In both this situation and the situation in which the yarn is intentionally severed due to the detection of an out-of-limits section of the yarn, there is a length of yarn already unwound from the supply package and this unwound length of yarn can be readily engaged by, for example, a conventional suction-type yarn engaging arm, for guiding of the unwound yarn length to a splicing device at which the unwound yarn length from the supply package is spliced with a length of yarn from the cross-wound package. Since the unwound yarn length of the supply package, commonly referred to as the lower yarn, is available in the above-described two types of yarn break situations, there is no need to replace the supply package with a fresh supply package. In other words, it is presumed that the supply package is still capable of supplying the lower yarn.

In a third type of yarn break situation which the apparatus disclosed in the Swiss Patent Document is adapted to handle, a break in the yarn occurs between the slub catcher and the supply package. Since the yarn continues to be wound onto the cross-wound package until the slub catcher indicates that the yarn is no longer traveling therethrough, the lower yarn below the location of the yarn break has already fallen under its own weight before the slub catcher can activate an appropriate component such as, for example, a yarn brake, to engage the lower yarn. The apparatus of the Swiss Patent Document evaluates this third type of yarn break as an indication that the supply package must be exchanged for a fresh supply package and a package exchange operation is accordingly implemented. However, the supply package may still have a quantity of yarn wound thereon—in other words, the supply package is not fully unwound—and so the replacement of the supply package with a fresh supply package is premature, necessitating additional steps that must be undertaken to further wind the remaining yarn of the supply package during another winding operation or to strip the remaining yarn to dispose the tube of the present supply package in an empty status for building another yarn package thereon.

German Patent Document 21 53 370 discloses a yarn feeler which is disposed for sensing the travel thereover of yarn at a location between the supply package and a yarn brake. The yarn feeler controls the operation of the yarn brake to engage the lower yarn in the event of a yarn break. However, yarn feelers of this type are typically relatively sensitive and will falsely indicate the occurrence of a yarn break even though no actual break has occurred. For example, the presence of soil and other debris may prompt the yarn feeler to falsely determine that a yarn break has occurred.

Accordingly, the need still exists for an apparatus which minimizes the number of supply packages still having remaining yarn which are prematurely exchanged for fresh supply packages in winding operations. Additionally, the need still exists for an apparatus which minimizes the number of attempts to engage an upper yarn of a cross-wound package during a procedure to restore the winding operation of a winding station.

SUMMARY OF THE INVENTION

The present invention provides a method and apparatus for restoring a normal yarn winding operation by performing a predetermined number of lower yarn end engaging attempts and first attempting an upper yarn end engaging attempt upon the detection of an engaged lower yarn end. Accordingly, the number of potentially package damaging attempts to engage an upper yarn end are minimized.

Briefly described, the present invention provides, in one aspect, a method for restoring the normal winding of yarn following a yarn break of the type which creates an upper yarn end on the package being wound due to an interruption in the yarn traveling from the supply package to the package being wound. The method includes executing a lower yarn end engaging cycle which includes performing at least one attempt to engage a lower yarn end from the supply package and detecting the presence or absence of engagement of a lower yarn end after the performing an attempt and exchanging the supply package for a new supply package in response to the detection of the absence of a lower yarn end after a predetermined number of the attempts to engage the lower yarn end.

The method also includes repeating the executing cycle and the exchanging the supply package until a selected one of the detection of a lower yarn end or the completion of a predetermined number of repetitions has occurred and executing an upper yarn end engaging cycle, in response to the detecting the presence of engagement of a lower yarn end, which includes performing an attempt to engage an upper yarn end from the package being wound and detecting the presence or absence of engagement of an upper yarn end after the performing an attempt.

Finally, the method includes performing a yarn joining cycle, in response to the detecting the presence of engagement of a lower yarn end, in which the detected upper yarn end and the detected lower yarn end are joined together. The method also preferably includes repeating the performing an attempt to engage an upper yarn end until a selected one of the detection of an upper yarn end or the completion of a predetermined number of repetitions has occurred and stopping the restoring of the normal winding of yarn if the predetermined number of repetitions of the performing an attempt to engage an upper yarn end has been completed.

The present invention also provides, in another aspect, an apparatus for restoring the normal winding of yarn following a yarn break of the type which creates an upper yarn end on the package being wound due to an interruption in the yarn traveling from the supply package to the package being wound.

The apparatus includes means for engaging a lower yarn end from the supply package, the lower yarn end engaging means being movable between a lower yarn end engaging position in which it is operable to engage a lower yarn end of a supply package and a lower yarn end positioning location in which it positions a lower yarn end for detection at a detection location. Also, the apparatus includes means for engaging an upper yarn end from the package being wound, the upper yarn end engaging means being movable between an upper yarn end engaging position in which it is operable to engage an upper yarn end from the package being wound and an upper yarn end positioning location in which it positions an upper yarn end for detection.

The apparatus additionally includes means for exchanging a supply package for a fresh supply package and means for detecting the presence or absence of a yarn end at the detection location, the detecting means being operable to selectively detect the presence or absence of a lower yarn end at the detection location in correspondence with the movement of the lower yarn end engaging means into the lower yarn end positioning location and being operable to selectively detect the presence or absence of an upper yarn end at the detection location. Finally, the apparatus includes means for controlling the exchanging means and the lower yarn end engaging means to perform a predetermined number of lower yarn end positioning cycles, each cycle including the operation of the exchanging means to perform an exchange operation in response to the detection by the detecting means of the absence of a lower yarn end at the detection location after the lower yarn end engaging means has completed a predetermined number of lower yarn end engaging operations and the operation of the lower yarn end engaging means to perform a predetermined number of lower yarn end engaging operations on each supply package following each the exchange operation.

The controlling means preferably includes means for controlling the upper yarn end engaging means to execute a predetermined number of upper yarn engaging operations in response to the detection by the detecting means of a lower yarn end and a lower yarn end counting device for counting the number of lower yarn end engaging operations, the lower yarn end counting device being operable to count a predetermined number of lower yarn end engaging operations.

The restoring apparatus preferably includes chamber means for selectively surrounding at least a portion of the supply package, the chamber means including means for directing streams of air tangentially against the outer surface of a supply package to facilitate the loosening of a yarn end therefrom.

The controlling means preferably includes means for controlling the operation of the air stream in coordination with the movement of the lower yarn end engaging means, the air stream controlling means being operable to stop the air stream in response to movement of the lower yarn end engaging means from the lower yarn end engaging position toward the lower yarn end detection location. The air stream controlling means preferably includes means for activating the air stream in response to the movement of the lower yarn end engaging means into the lower yarn end engaging position.

The air stream controlling means preferably includes means for controlling the air streams to operate during a subsequent attempt to loosen a yarn end for a relatively longer period of time than the period of time during which the air streams are directed against the package during an initial attempt to loosen a yarn end therefrom.

The restoring apparatus preferably also includes means for determining the presence or absence of a predetermined minimum remaining amount of yarn on a supply package, the controlling means controlling the exchanging means to exchange the respective supply package for a fresh supply package in response to a determination by the remaining yarn amount determining means that the respective supply package has less than the predetermined minimum remaining amount of yarn.

The remaining yarn determining means preferably includes a photoelectric sensor. The controlling means preferably includes means for measuring the length of yarn traveling from the supply package and the package being wound, the controlling means being operable to determine the remaining amount of yarn on a supply package based upon information received from the measuring means.

The restoring apparatus also preferably includes ready position sensing means for sensing the presence of a fresh supply package at a ready position in which fresh supply packages are held immediately before they are supplied to the winding station in an exchange operation and the controlling means is operable to prevent the exchanging means from performing an exchange operation during one of the lower yarn end positioning cycles in response to sensing by the ready position sensing means that no fresh supply package is present at the ready position.

The controlling means preferably includes a plurality of timing cams, commonly mounted on a timing camshaft, the timing camshaft being rotatable in an advancing direction through a predetermined angular movement to control the exchanging means and the lower yarn end engaging means to perform the predetermined number of lower yarn end positioning cycles, the timing camshaft being rotatable in a direction opposite to the advancing direction through a predetermined angular movement in response to the detecting by the detecting means of the absence of a lower yarn end at the detection location, the predetermined angular movement of the timing camshaft in the opposite direction being selected to return the timing camshaft to a predetermined angular position corresponding to the beginning of the predetermined angular movement of the timing camshaft during which the timing camshaft controls the exchanging means to perform an exchange operation.

The restoring apparatus preferably includes means for indicating that a problem has occurred in a restoring operation, means for determining movement of the upper yarn end engaging means into the upper yarn end detection location, the upper yarn end movement determining means being operatively connected to the controlling means, and means for counting the number of attempts by the upper yarn end engaging means to engage an upper yarn end, the upper yarn end engaging attempts counting means being operatively connected to the controlling means and the controlling means being operable to move the timing camshaft in the opposite direction through a predetermined angular movement in response to a signal from the upper yarn end movement determining means indicating that the upper yarn engaging means has moved into the upper yarn end positioning location in correspondence with a signal from the detecting means indicating the absence of an upper yarn end, the controlling means controlling the timing camshaft to return to a predetermined angular position corresponding to the beginning of the angular movement of the timing camshaft during normal winding of yarn and to activate the problem indicating means in response to the counting by the upper yarn end engaging attempts counting means that a predetermined number of upper yarn end engaging operations have been completed without the detecting by the detection means of an upper yarn end at the detection location.

The controlling means preferably includes means for controlling the upper yarn end engaging means to remain at the upper yarn end engaging position for a relatively longer period of time during subsequent upper yarn end engaging attempts than during the initial upper yarn end engaging attempt. The controlling means preferably includes a timing apparatus having a plurality of timing cams, each individually associated with a respective component of the restoring apparatus, and a timing camshaft on which the timing cams are commonly mounted.

The controlling means preferably includes means for controlling the timing camshaft to rotate relatively slower through its particular angular movement during control of the upper yarn engaging means to engage an upper yarn end in subsequent upper yarn end engaging attempts in comparison to the rate of rotational movement of the timing camshaft through its predetermined angular movement during which the upper yarn end engaging means is controlled to engage an upper yarn end in an initial upper yarn end engaging attempt.

The controlling means preferably includes means for controlling the rotation of the cross-wound package to effect rotation of the package being wound in a direction opposite to its rotating direction at a relatively slower rotational speed during an upper yarn end engaging operation than the rotational speed of the package being wound during normal winding operation.

DETAILED DESCRIPTION OF THE PREFERRED EMBODIMENT

Figure 1:
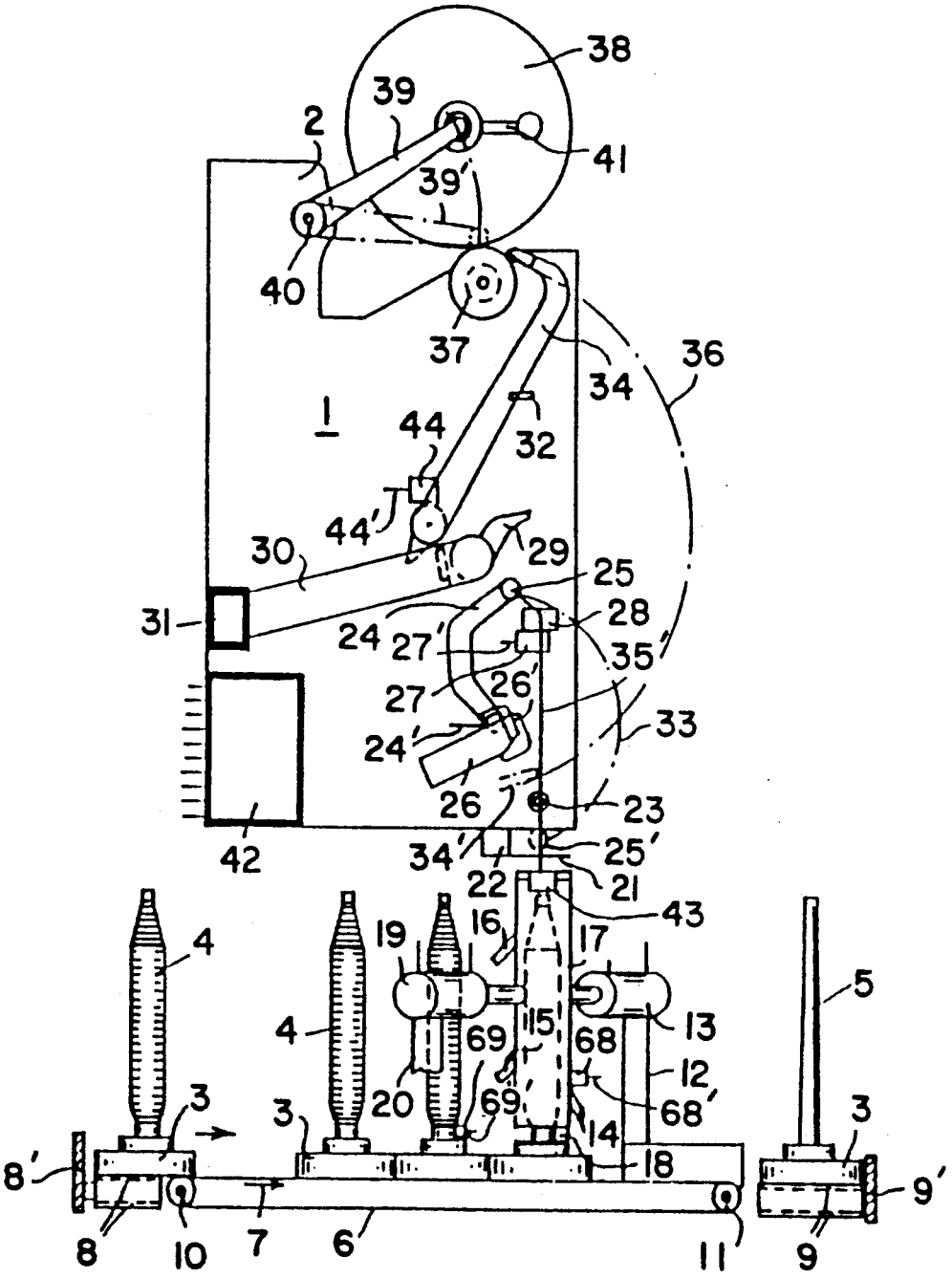
FIG. 1 is a side elevational view of a winding station of a textile winding machine incorporating the restoring apparatus of the present invention, showing the operational positions of the components of the winding station following the placement of a lower yarn end in the yarn splicing component of the winding station during a restoring operation.
Figure 2:
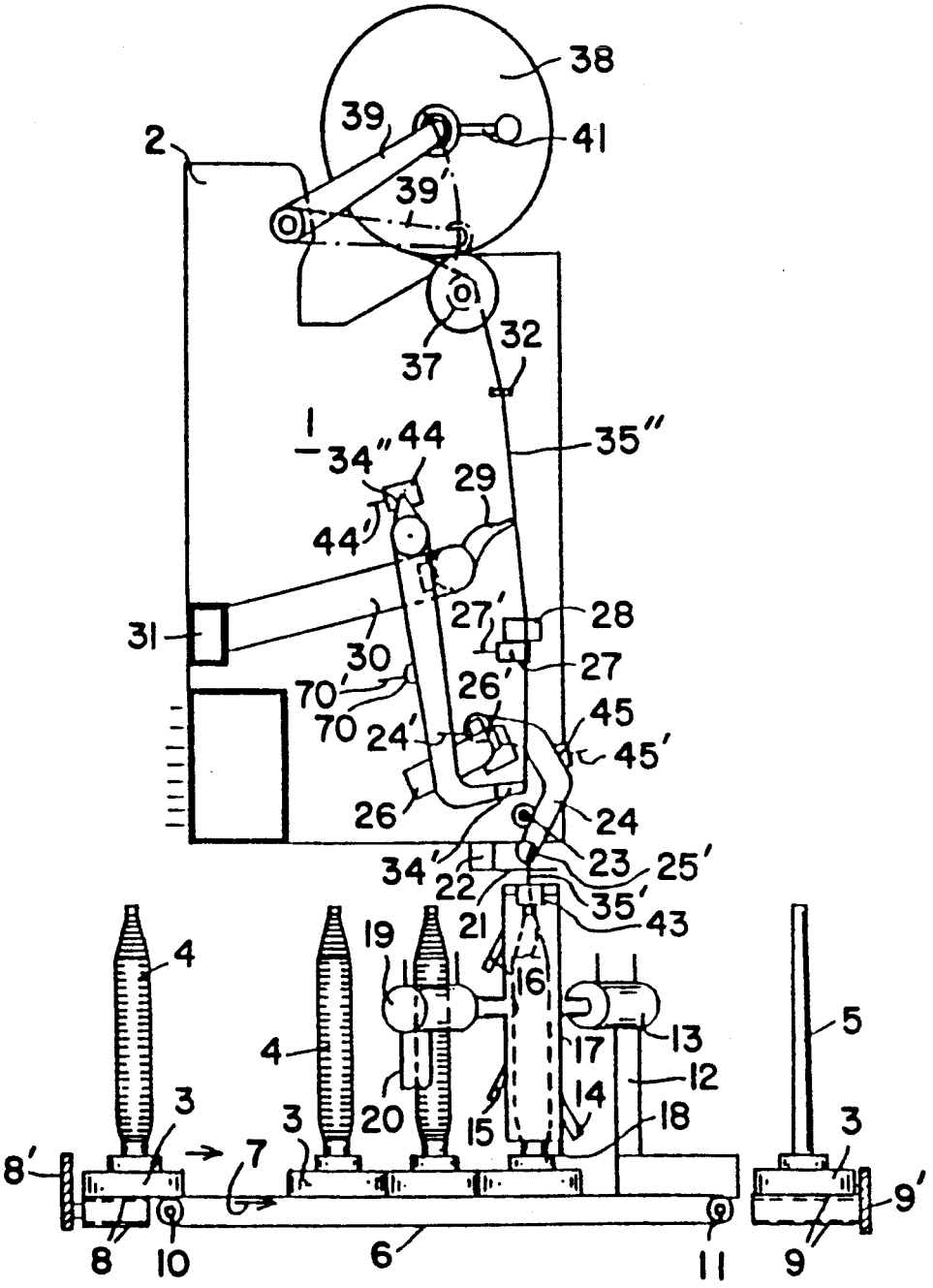
FIG. 2 is a side elevational view of the winding station shown in FIG. 1, showing the operational positions of the components of the winding station after an upper yarn end has been disposed in the yarn splicing component and before a lower yarn end has been disposed in the yarn splicing component.

In FIGS. 1 and 2, a winding station 1 of a textile winding machine is illustrated, it being understood that the textile winding machine also includes a plurality of identically configured winding stations (not shown). The winding stations of the textile winding machine are arranged in a row in a direction transverse to the plane of FIGS. 1 and 2. Each winding station 1 is operable to wind yarn from a supply package onto a cross-wound package and each winding station incorporates the restoring apparatus of the present invention for restoring the winding operation of the winding station following a break in the feed of yarn.

The textile winding machine receives supply packages from a textile spinning machine (not shown) which includes spinning stations of which repetitively perform a yarn building operation in which yarn is built onto an empty tube individually supported in an upright disposition on a tube support member 3 to form a yarn package 4. The tube support members 3 are of the type having a cylindrical base portion, a relatively smaller diameter cylindrical neck portion and a vertical post. The yarn packages 4 are then transported, with the tubes still in an upright disposition, on the tube support members 3 to a supplying location at one end of the textile spinning machine for supplying of the yarn packages to the textile winding machine.

The winding station 1 includes a frame 2 on which is mounted a cross-wound package support arm 39 for supporting a cross-wound package 38 thereon. A package delivery assembly includes an endless belt 8 extending from a package supply location (not shown) along one side of the winding stations 1.

The package delivery assembly also includes a lateral side member 8' in the form of a wall extending adjacent one side of the endless belt 8 for preventing lateral movement of the tube support members 3 outwardly beyond the endless belt 8.

A cross-transport assembly includes an endless belt 6 trained around a pair of rollers 10, 11. The upper run of the endless belt 6 travels in the direction shown by an arrow 7 in FIGS. 1 and 2 through a package winding location adjacent the winding station 1 at which a supply package is supported during winding of yarn therefrom by the winding station.

The endless belt 8 of the package delivery assembly extends adjacent a respective end of the endless belt 6 and is operable to transport the tube support members 3, with the yarn packages 4 supported in upright dispositions thereon, to the respective adjacent end of the endless belt 6 for engagement by the endless belt to effect transfer of the tube support members 3 from the endless belt 8 of the package delivery assembly to the endless belt 6 of the cross-transport assembly. The endless belt 6 transports the tube support members 3 in the direction shown by the arrow 7 to the package winding location and, after winding of the yarn package supported on the respective tube support member 3, the respective tube support member, which now supports an empty tube 5 thereon, is further transported by the endless belt 6 to a tube discharge assembly having an endless belt 9 positioned adjacent the other end of the endless belt 6.

The endless belt 9 extends along the winding stations on the opposite side thereof with respect to the side along which the endless belt 8 of the package delivery assembly extends and is operable to transport the tube support members 3 having empty tubes 5 supported thereon, to a tube transfer location (not shown). The tube discharge assembly includes a lateral side member 9' in the form of a wall extending adjacent the outward lateral side of the endless belt 9 for preventing lateral movement of the tube support members 3 laterally beyond the endless belt 9 during their transport thereby.

A control unit 42 is mounted on the frame 2 and is in the form, for example, of a conventional computer for controlling the various operations of the winding station 1.

At the package winding location, a chamber means 17 is provided for selectively controlling the release of tube support members 3 with empty tubes 5 thereon from the package winding location and the supply of fresh yarn packages 4 to the package winding location. Additionally, the chamber means 17 is operable to provide a cylindrical chamber for partially surrounding the yarn package supported at the package winding location to facilitate the unwinding of a yarn end therefrom during a winding operation. The structure and operation of the chamber member 17 is described in more detail in co-pending U.S. patent application Ser. No. 456,384, filed Dec. 26, 1989, now U.S. Pat. No. 5,035,371, which is incorporated by reference herein.

As seen in FIGS. 1 and 2, the chamber means 17 includes a support frame, a first support post 12 extending vertically from the support frame and supporting a first movement means 13, a first connector, and a first chamber portion and a second support post 20 supporting a second movement means 19, a second connector and a second chamber portion. The first chamber portion and the second chamber portion form a gas guide chamber when they are in mating contact with one another. The first movement means 13 and the second movement means 19 are each configured as a conventional hydraulic cylinder actuable to selectively retract and extend the respective associated connector, which are each configured as conventional hydraulic cylinder rods. The first movement means 13 and the second movement means 19 are each operatively connected by a plurality of conventional connectors to a conventional control unit 42 mounted to the winding station 1.

The first chamber portion is fixedly connected to the free end of the first connector. The second chamber portion is fixedly connected to the free end of the first connector. As seen in FIG. 1, the first chamber portion and the second chamber portion support a plurality of jet nozzles 14, 15, 16 which are operatively connected by a plurality of flexible conduits to a conventional regulating valve (not shown). The regulating valve regulates the outflow of compressed gas from a conventional compressed gas source operatively connected to the control unit 42. The jet nozzles 14, 15, 16 direct jet streams of gas, which are supplied via the conduits from the compressed gas source, against a yarn package positioned between the first chamber portion and the second chamber portion to loosen a yarn end on the yarn package, as described in more detail below.

The chamber means 17 operates as follows to loosen a yarn end of a yarn package supported on one of the tube support members and to support the yarn package during subsequent unwinding of the yarn from the yarn package at the winding station 1. The tube support members, each supporting a tube having a yarn package built thereon such as, for example, the yarn packages supported on the tube support members, are delivered by the package delivery assembly to the cross-transport assembly for feeding to the winding station 1. In conventional manner, the tube support members are loaded onto the endless belt 6 of the cross-transport assembly such that they are transported in the direction of travel while arranged serially with respect to each other, as seen in FIG. 1.

As the tube support members travel in the direction of travel toward the package winding location, the second chamber portion is initially disposed in a clearance position in which it is sufficiently spaced from the cross path to permit the tube support members to be moved therepast by the cross-transport assembly. The second chamber portion is disposed in its clearance position by appropriate control of the second movement means 19 by the control unit 42. Specifically, the control unit 42 controls the second movement means 19 to cause it to be charged with a conventional hydraulic fluid from a conventional hydraulic fluid source (not shown). The charging of the second movement means 19 with hydraulic fluid causes the first connector to be retracted into the second movement means 19, thereby displacing the second chamber portion laterally toward the same side of the cross-transport assembly as the side on which the second support post 20 is disposed to an extent sufficient for the cylindrical body portion and the foot portion to be clear of the cross path.

The first chamber portion is initially disposed in the chamber forming position whereby it intersects the cross path and the semi-cylindrical body portion and the foot portion of the first chamber portion face in the direction opposite to the direction of travel.

The cross-transport assembly eventually moves the forward-most tube support member, as viewed in the direction of travel, past the second chamber portion, which is disposed in its clearance position, and, further, into contact with the inner surface of the first chamber portion. The base cylindrical plate of the tube support member contacts the foot portion, whereby further travel of the tube support member in the direction of travel is prevented. The tube support member, which is the next tube support member following the tube support member, has its base cylindrical plate in contact with the base cylindrical plate of the preceding tube support member due to the continuous action of the endless belt of the cross-transport assembly.

The control unit 42 then controls the second movement means 19 to extend the second connector to thereby effect movement of the second chamber portion from its clearance position to the chamber forming position in which the second chamber portion and the first chamber portion mate along a first engagement line and a second engagement line with the yarn package supported on the tube support member supported in an upright disposition therebetween. The foot portion of the second chamber portion displaces the tube support members slightly in the direction opposite to the direction of travel during the movement of the second chamber portion from its clearance position to the chamber forming position. Accordingly, once the second chamber portion is disposed in the chamber forming position, the foot portion extends between the respective cylindrical base plates of the tube support member and the tube support member to thereby space the two tube support members from one another.

The gas guide chamber formed by the first chamber portion and the second chamber portion provides a substantially sealed enclosure along the extent of the yarn package supported on the tube support member. Accordingly, once the second chamber portion mates with the first chamber portion to form the gas guide chamber, the control unit 42 can control the regulating valve to supply compressed gas to the jet nozzles 14, 15, 16. As seen in FIG. 1, the jet nozzles are oriented to direct jet streams of gas in inclined tangential directions with respect to the yarn package to loosen a yarn end of the yarn package.

The loosened yarn end is directed upwardly under the influence of a helical gas flow which occurs due to the orientation of the jet nozzles 14, 15, 16 and the cylindrical shape formed by the semi-cylindrical body portions of the first chamber portion and the second chamber portion. The helical flow of gas eventually lifts the loosened yarn end toward the top of the gas guide chamber for engagement of the yarn end by the suction mouth 25 of the lower yarn end engaging member 24.

Once the yarn on the yarn package supported on the tube support member has been completely unwound, only an empty tube remains on the tube support member. In correspondence with the completion of the unwinding of the yarn package, the control unit 42 controls the first movement means 13 to retract the connector to thereby move the first chamber portion from the chamber forming position to a clearance position in which the first chamber portion is cleared from the cross path sufficiently for the tube support member to be conveyed therepast by the cross-transport assembly toward the discharge location. A stop member 18 extends from the first chamber portion and is adapted for engaging the cylindrical base portion of a tube support member which has been transported into the package winding location to prevent further travel therepast of the tube support member. The stop member 18 is configured to permit travel therepast of the respective tube support member 3 when the first chamber portion is retracted. Additionally, the control unit 42 controls the second movement means 19 to retract the second chamber portion from the chamber forming position to its respective clearing position.

Once the second chamber portion reaches its respective clearance position, the next following tube support member is moved by the action of the cross-transport assembly in the direction of travel into the package winding location. In coordination with the movement of the tube support member into the package winding location, the control unit 42 controls the first movement means 13 to move the first chamber portion from its respective clearance position to a travel blocking position in which the foot portion sufficiently extends into the cross path at the package winding location to prevent further travel of the tube support member in the direction of travel.

The movement of the first chamber portion from its respective clearance position to the travel blocking position is timed in coordination with the movement of the support member, which has just exited the package winding location, such that the tube support member has traveled sufficiently beyond the first chamber portion to preclude the movement of the first chamber portion from its clearance position to the travel blocking position from hindering the movement of the tube support member toward the discharge location. Depending upon the operating circumstances, the travel blocking position of the first chamber portion may be substantially coincidental with its chamber forming position. In other operating circumstances, the travel blocking position may entail the positioning of the foot portion only slightly into the cross path but to a sufficient extent to prevent further travel of the next following tube support member. Thereafter, the first chamber portion is moved to the chamber forming position.

Once the next following tube support member is positioned at the package winding location in contact with the first chamber portion, the control unit 42 controls the second movement means 19 to move the second chamber portion from its respective clearance position to the chamber forming position. During this movement, the second chamber portion contacts the tube support member, which is now the next following tube support member with respect to the tube support member at the package winding location, and displaces the tube support member in a direction opposite to the direction of travel as the second chamber portion moves into the chamber forming position. The foot portion is now interposed between the respective cylindrical base plates of the tube support members. In correspondence with the movement of the second chamber portion into the chamber forming position, the control unit 42 controls the regulating valve to supply compressed gas to the jet nozzles 14, 15, 16 to perform a yarn end loosening operation on the yarn package supported by the tube support member.

A conventional slub or loop catcher 21 is disposed above the chamber means 17 for handling the yarn as it travels upwardly beyond the chamber means. The slub catcher 21 is operated by a drive means 22. The present invention also contemplates that a yarn balloon control member 43 can be movably mounted on one of the chamber portions for movement between an out of interference position in which it is clear of the travel path of the yarn and a balloon control position on which it is positioned adjacent the top of the chamber means 17 for controlling the ballooning of the yarn as it is wound from the yarn package 4.

A sensor 68 is mounted in the first chamber portion and is operatively connected via a connector 68' to the control unit 42. The sensor 68 is operable to sense the presence or absence of a predetermined minimum amount of yarn still remaining on a yarn package 4 supported at the package winding location and, in this regard, the sensor 68 can be configured, for example, as a conventional photoelectric sensor which optically senses the amount of yarn.

A sensor 69 is supported adjacent the travel path of the endless belt 6 by a support member (not shown) and is operatively connected via a connector 69' to the control unit 42. The ready position sensor 69 is operable to sense the presence or absence of a tube support member 3 at a ready position relative to the package winding location. The ready position is the location at which the next, immediately following tube support member 3 is maintained relative to the respective tube support member 3 at the package winding location. Upon transport of the respective tube support member 3 from the package winding location, the next, immediately following tube support member 3 maintained at the ready position is transported by the endless belt 6 into the package winding location. The ready position sensor can be configured, for example, as a conventional photoelectric sensor which generates a signal in response to the interruption of a light beam emitted thereby.

The winding station 1 includes a lower yarn engaging member 24 in the form of a pivotally mounted suction conduit having an opening 25 for applying a suction to a lower yarn end which has been propelled upwardly beyond the top of the chamber halves of the chamber means 17. Prior to or in correspondence with the loosening of the yarn end of the yarn package 4 supported at the package winding location, the lower yarn end engaging member 24 is disposed in its engaging position shown in FIG. 2 in which its suction opening 25 is positioned relatively shortly above the slub catcher 21 for engaging the loosened yarn end as it travels upwardly beyond the chamber halves of the chamber means 17 under the action of the tangential air blast. As seen in FIGS. 1 and 2, the lower engaging member 24 is pivotable with respect to the frame 2 to move the suction opening 25 from a lower yarn end engaging position 25' through an arc 33 to a lower yarn end positioning location or, preferably, a cutting disposing position, shown in FIG. 1, in which the lower yarn end 35' is disposed in a yarn cutting and clamping device for cutting prior to splicing. The lower yarn end engaging member 24 is operatively connected via a conventional connector (not shown) to the suction conduit 3!. In one modification of the lower yarn end engaging member 24, a clamping device is provided for releasably clamping a yarn end drawn into the engaging member. In another modification, the circumference of the suction opening 25 is roughened to resist the outward movement of yarn from the lower yarn end engaging member 24.

A yarn tensioning member 23 is mounted to the frame 2 and includes an opening disposed adjacent the travel path of the yarn for applying a relatively slight suction thereto to effect tensioning of the yarn during its travel. The opening of the yarn tensioning member 23 is disposed intermediate the yarn cleaner 27 and the top of the chamber means 17 relative to the direction of travel of the yarn.

During a winding operation, yarn is wound from the respective yarn package 4 supported at the package winding location onto the cross-wound package 38. During its travel from the yarn package 4 positioned at the package winding location (the supply package), the yarn travels past an electronic yarn cleaner 27 which is operatively connected via a connector 27' to a control unit 42 mounted on the frame 2. A conventional yarn cutting and clamping device 28 is disposed adjacent the yarn cleaner 27 and upstream of the yarn cleaner 27 relative to the direction of travel of the yarn from the supply package to the cross-wound package 38. A yarn guide 32 is disposed along the travel path of the yarn upstream of the yarn cutting and clamping device 28 and the yarn cleaner 27 relative to the direction of travel of the yarn. A traversing feed drum 37 is mounted relative to the travel path of the yarn for feeding the yarn in a traversing manner onto the cross-wound package 38. The traversing feed drum 37 is disposed intermediate the yarn guide 32 and the cross-wound package 38.

The winding station 1 further includes an upper yarn end engaging member 34 including a suction head having a slot extending generally the length of the cross-wound package 38 for applying suction to the cross-wound package. The upper yarn end engaging member 34 is pivotally mounted to the frame 2 and is operatively interconnected to a suction source (not shown) for applying the suction through the suction head to draw an upper yarn end from the cross-wound package 38 into the upper yarn end engaging member 34.

The upper yarn end engaging member 34 is normally maintained in its lower position, shown in FIG. 2, in which its suction head is disposed in a position 34' adjacent the travel path of the yarn intermediate the yarn tensioning member 23 and the yarn cleaner 27. The upper yarn end engaging member 34 is pivotable to move its suction head through an arc 36, shown in FIG. 1, to move its suction head from the location 34' to an upper yarn end engaging location adjacent the traversing feed drum 37 and the cross-wound package 38, as shown in FIG. 1, for engaging an upper yarn end of the cross-wound package 38.

An initiator means 44 is mounted to the frame member 2 adjacent the end of the upper yarn end engaging member 34 which is pivotally connected to the frame 2. The initiator means 44 is operatively connected via a connector 44' to the control unit 42 and is operable to detect movement of the upper yarn end engaging member 34 into its normal lower position in which its suction head is disposed at the location 34'.

The winding station 1 also includes a conventional yarn splicing assembly 26 includes a prismatic splicing head 26' operable to receive an upper yarn end and a lower end therein for splicing together of the yarn ends. The structure and operation of the yarn splicer 26 is described in detail in German Patent Publication DE-A 31 32 895, which is incorporated by reference herein. The yarn splicer 26 includes nozzles for applying suction to the upper and lower yarn ends to engage the yarn ends while they are respectively engaged by the lower yarn engaging member 24 and the upper yarn end engaging member 34. The engaging action of the suction nozzles draws the upper and lower yarn ends into their splicing ready positions adjacent one another within the prismatic splicing head 26'. The splicing of the upper and lower yarn ends involves the application of compressed air to the upper and lower yarn ends disposed in the prismatic splicing head 26' to effect intertwining of the fibers of the yarn ends with one another.

A suction arm 30 is operatively interconnected to a suction conduit 31 which extends along the row of winding stations and is operatively connected to a suction source (not shown). The suction arm 30 includes a movable suction head 29 pivotally mounted to the end of the suction arm 30 opposite the end of the suction arm which is operatively interconnected to the suction conduit 31.

The package support member 39 includes a handle 41 for engagement by an operator to move the package support member 39 from its initial position 39' to a loading position in which an empty tube can be inserted on the package support member. The initial position 39' of the package support member 39 is a position in which the package support member supports an empty tube against the traversing feed drum 37 in readiness for the beginning of winding of yarn onto the empty tube by the traversing feed drum 37.

The cross-wound package 38 is normally built with the yarn wound from several of the yarn packages 4. The preparation for feeding of yarn from an initial supply package to an empty tube supported on the package support member 39 on which a cross-wound package is to be built is accomplished in conventional manner which will not be described in further detail herein. The yarn from the initial yarn package 4 supported at the package winding location is continuously unwound from the yarn package and fed by the traversing feed drum 37 onto the tube supported by the package support member 39 to build the cross-wound package 38. During the travel of the yarn from the yarn package 4, the yarn travels upwardly beyond the chamber halves of the chamber means 17, through the slub catcher 21, past the opening of the yarn tensioning member 23, through the yarn cleaner 27, the yarn cutting and clamping device 28, the yarn guide 32 and onto the traversing feed drum 37 for feeding onto the cross-wound package tube. As the yarn travels through the yarn cleaner 27, the yarn cleaner provides a dynamic yarn signal via the connector 27' to the control unit 42 which indicates that the yarn cleaner 27 is sensing dynamic movement of the yarn. During this normal winding of the yarn in a winding operation, the upper yarn end engaging member 34 is maintained in its normal lower position in which its suction head is disposed at the location 34'. The normal position of the lower yarn end engaging member 24 during normal winding of yarn prior to a yarn break is a position at which the lower yarn end engaging member 24 is disposed out of interference with the traveling yarn. In this out of interference position, the suction opening 25 of the lower yarn end engaging member 24 is disposed generally in alignment with the drive means 22 of the slub catcher 21 relative to a line extending parallel to the row of the winding stations.

In the event of a break in the yarn traveling from the yarn package 4 to the cross-wound package 38, the yarn cleaner 27 ceases to transmit a dynamic yarn signal to the control unit 42 and a predetermined series of steps are implemented in accordance with the method of the present invention. These steps are discussed in more detail below with respect to the flow charts shown in FIGS. 3*a* and 3*b*. There are a number of suitable conventional control systems which can be coupled with the control unit 42 to control the individual movements of the various components of the winding station 1 in response to the various decisions made by the control unit 42. For example, one such arrangement could include a common drive shaft having a number of timing cams mounted thereon with each of the other cams being individually associated with a particular component for selectively activating and deactivating the individual component in correspondence with the rotation of the common drive shaft through a prescribed angular position during rotation of the drive shaft through a complete 360° revolution. It is desirable to provide a first such timing cam arrangement for controlling the individual movements of the various components which perform the engaging of the upper and lower yarn ends and the splicing together of the yarn ends and to provide a second timing cam arrangement, operatively interconnected to the first timing cam arrangement, which controls the movement of the various components which perform a package exchange operation.

Figure 3A:
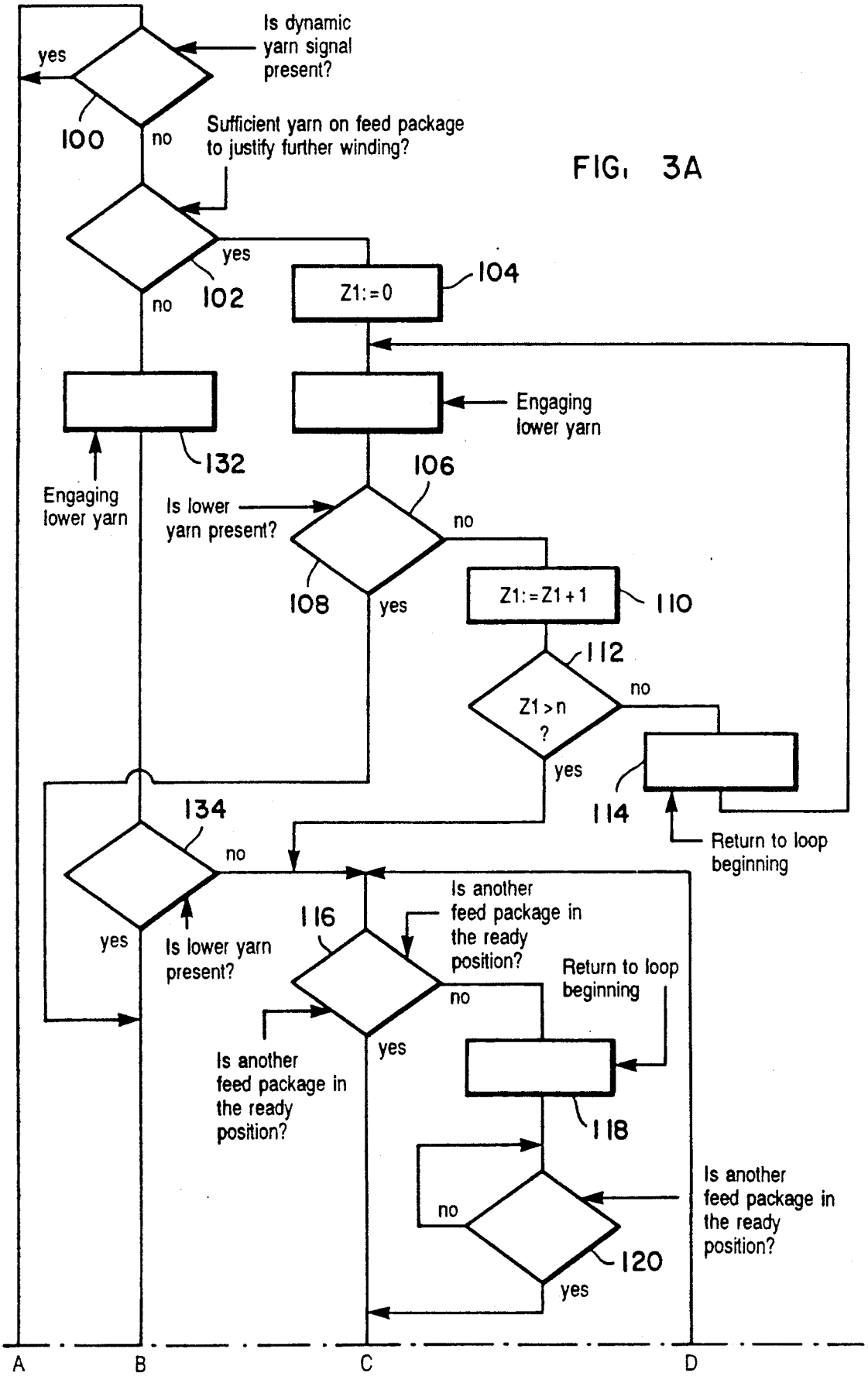
FIG. 3*a* is a flow diagram of several steps of a restoring operation in accordance with the method of the present invention.
Figure 3B:
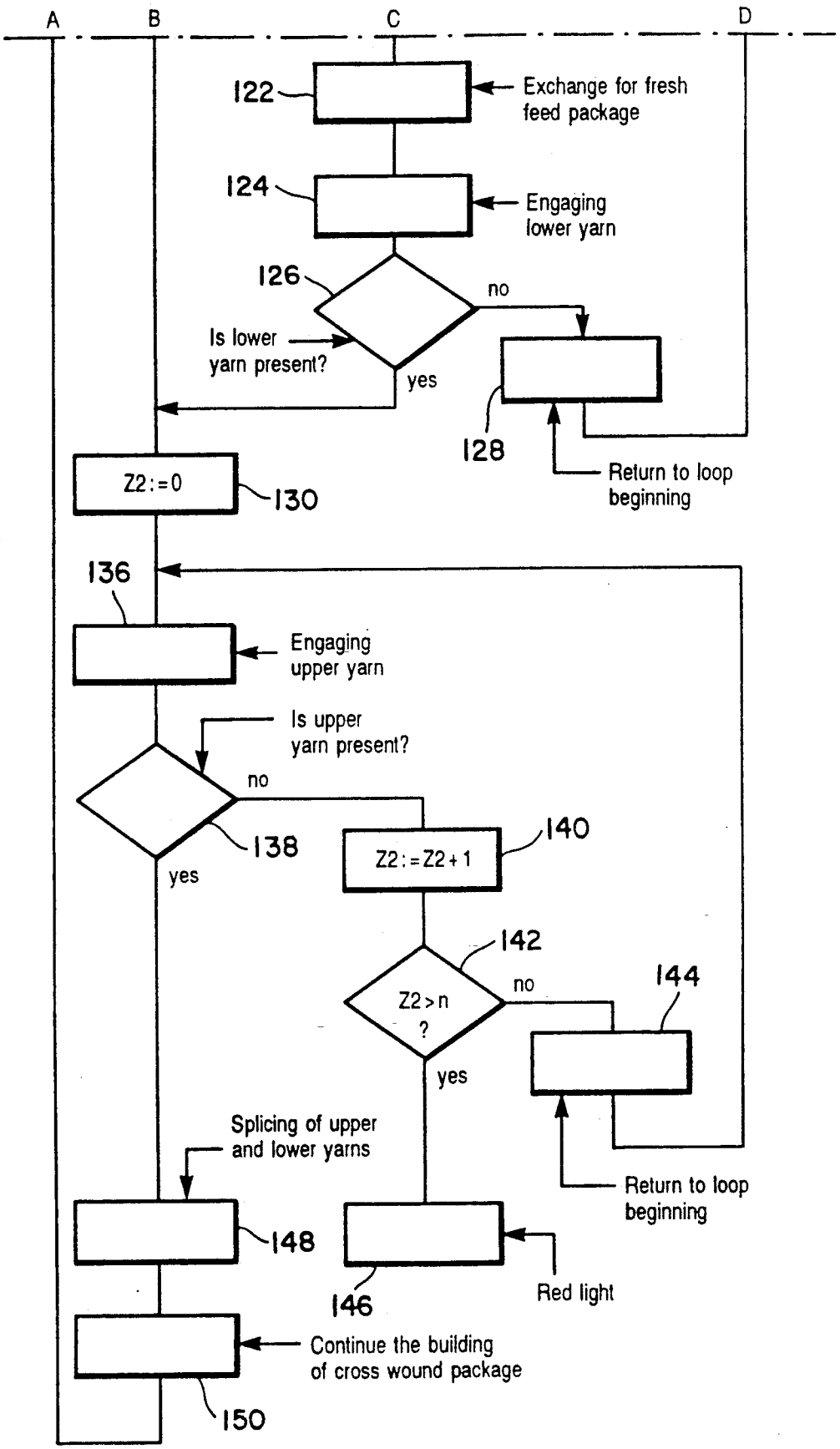
FIG. 3*b* is a flow diagram of the remaining steps of the restoring operation illustrated in FIG. 3*a;*
Figure 4:
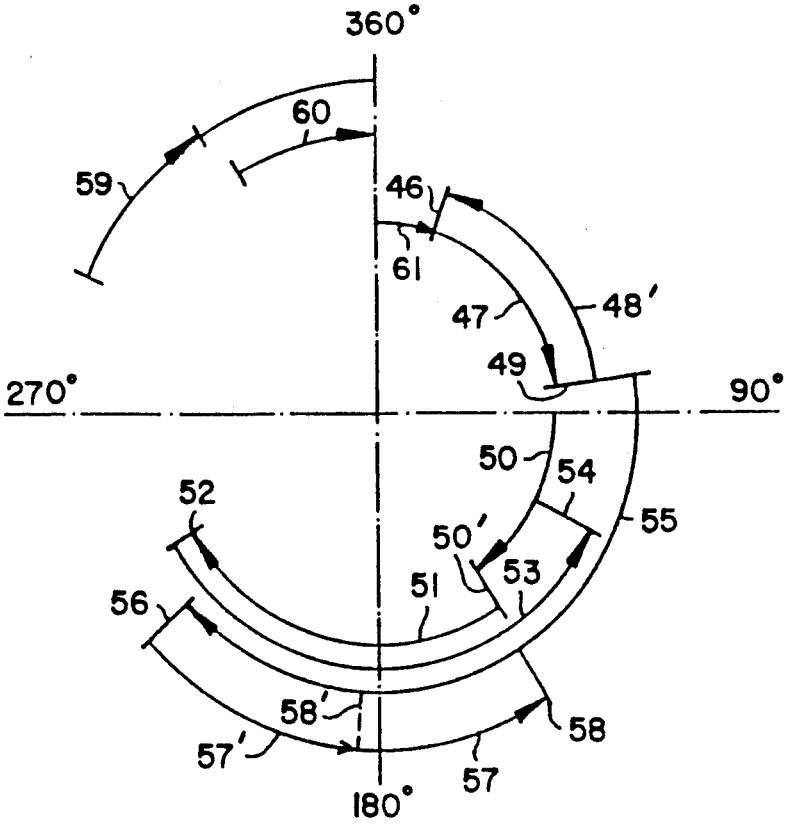
FIG. 4 is a schematic representation of the sequential movements of a timing cam-type control component of the restoring apparatus of the present invention.
Figure 5:
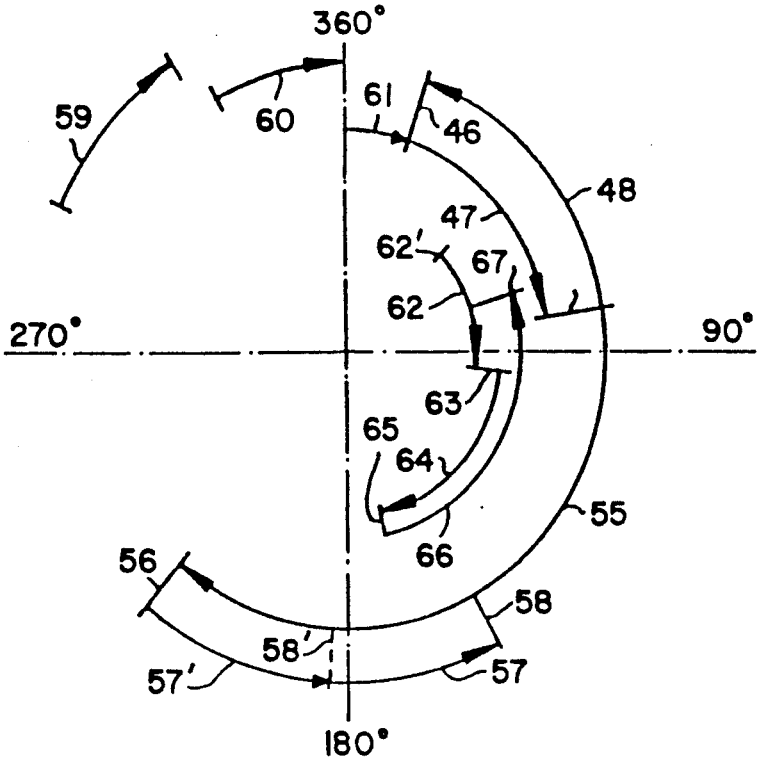
FIG. 5 is a schematic representation of the sequential movements of another configuration of a timing cam-type control component of the restoring apparatus of the present invention.
Figure 6:
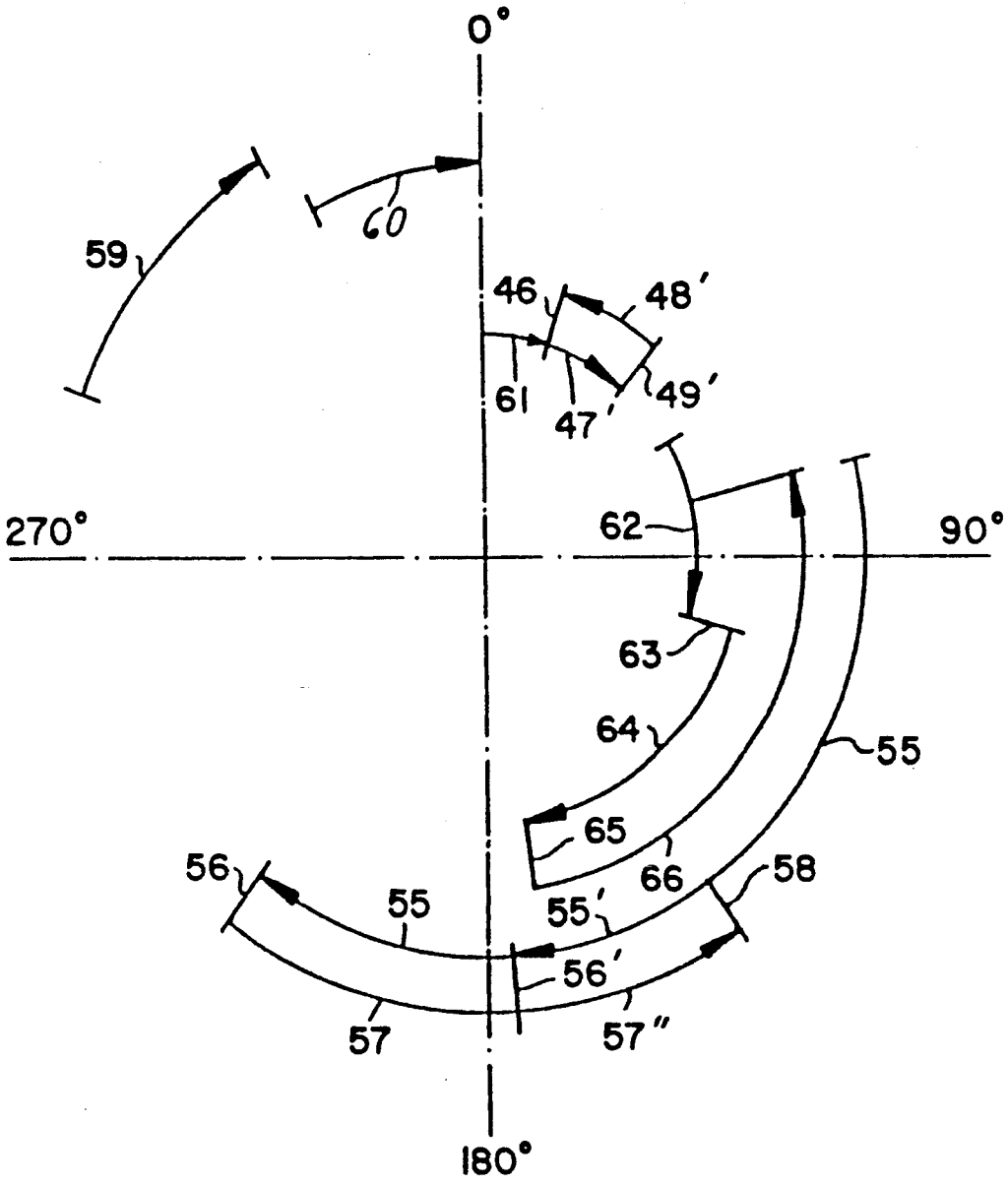
FIG. 6 is a schematic representation of the sequential movements of yet another configuration of a timing cam-type control component of the restoring apparatus of the present invention.

Each of FIGS. 4–6 schematically illustrates the possible angular movements of three different respective timing cam arrangements. For the sake of illustration, the angular movements of the respective timing camshaft schematically illustrated in FIG. 4 will be discussed with respect to the discussion of the operation of the restoring apparatus in connection with FIGS. 1 and 2 as well as in connection with the flow charts in FIGS. 3*a* and 3*b*.

As seen in FIG. 4, the initial angular position of the timing camshaft is the position at which the timing camshaft is disposed during normal yarn winding prior to a yarn break, schematically represented by the 360° mark. In this angular position of the timing camshaft, the lower yarn end engaging member 24 is in its normal lower position as shown in FIG. 1, the upper yarn end engaging member 34 is in its normal lower position as shown in FIG. 2, and the yarn is continuously traveling from the respective yarn package 4 at the package winding location and over the traversing feed drum 37 as it is fed onto the cross-wound package 38.

To permit the control unit 42 to control the angular movement of the timing camshaft, a drive means (not shown) for driving the shaft on which the timing cam is mounted can be in the form of a reversible motor which is responsive to four different switch positions—namely a forward switch position 1/0 in which the timing cam is rotated in an advancing direction; a reverse switch position 0/1 in which the timing cam is rotated in a direction opposite to its advancing rotation direction; a standstill switch position 0/0 in which the timing cam is maintained at a predetermined angular position; and a break switch position 1/1 in which the angular movement of the timing cam is braked.

The timing camshaft can be provided with a magnetic wheel which is monitored by sensors positioned adjacent the shaft. This arrangement permits the position of the timing camshaft to be constantly monitored. The operative connection between the drive means and the drive shaft can be provided, for example, by a conventional worm gear arrangement. This arrangement insures that the timing camshaft remains in the predetermined angular position in which it stops at the end of its angular movement until the drive means is again activated to rotate the timing camshaft.

As schematically illustrated in FIG. 3*a*, the control unit 42 performs an evaluation step !00 during which it evaluates the presence or absence of the dynamic yarn signal transmitted by the yarn cleaner 27. If the dynamic yarn signal is no longer present, the control unit 42 then performs an evaluation 102 in which it evaluates whether the yarn package 4 supported at the package winding location has a sufficient amount of still remaining yarn wound thereon to justify the further unwinding of the still remaining yarn from the yarn package 4.

The control unit 42 performs the evaluation step 102 by evaluating information received from the sensor 68 which optically senses the amount of still remaining yarn. The control unit 42 can alternatively receive information from a conventional yarn length counting device which operates to continuously aggregate the cumulative length of yarn which travels thereover. For example, the conventional yarn length counting device can be of the type which includes a rotating wheel over which the yarn travels which rotates in correspondence with the rate of movement of the yarn thereover and a counting device which counts the number of revolutions of the rotating wheel to provide information concerning the aggregate length of yarn which has been unwound from the yarn package 4.

If the control unit 42 determines that the still remaining yarn on the yarn package 4 is of a length sufficient to justify further winding of the yarn, the control unit 42 sets the count Z1 of a lower yarn counter to 0 in a zeroing step 104. The count Z1 represents the number of attempts to engage a lower yarn end 35' of the yarn package 4. In correspondence with the performance of the zeroing step 104, the control unit 42 controls the appropriate components of the winding stations to effect engagement of the lower yarn end by the lower yarn end engaging member 24. The lower yarn end engaging member 24 is controlled to pivot from its normal upper position as shown in FIG. 1 to its lower engaging position in which the suction opening 25 is positioned at the location 25' adjacent the travel path of the yarn. Also, the control unit 42 controls the chamber means 17 to perform a yarn end loosening operation in the manner discussed previously, to loosen the lower yarn end of the still remaining yarn on the yarn package 4.

In correspondence with the setting of the lower yarn counting device to zero in the step 104, the control unit 42 performs a step 106 to effect engagement of the lower yarn end 35'. The step 106 is implemented by rotation of the timing camshaft from its 360° position through a predetermined angular movement schematically illustrated by the arcuate arrow 61 in FIG. 4 and, in correspondence with this angular movement of the timing camshaft, the lower yarn end engaging member 24 is controlled to pivot in a counter-clockwise manner as viewed in FIG. 1 from its normal out of interference position (not shown) in which its suction opening 25 is behind the drive means 22 of the slub catcher 21 as viewed in FIG. 1 to its yarn end engaging position, as shown in FIG. 2, in which its suction opening 25 is in the location 25' generally vertically aligned with the supply package 4 thereunder. The radial line segment 46 in FIG. 4 schematically illustrates the positioning of the suction opening 25 at the location 25' in readiness for engaging a lower yarn end of the supply package 4 at the package winding location.

In correspondence with the movement of the lower yarn end engaging member 24 into its yarn engaging position, the chamber means 17 is operated as previously described to perform its yarn end loosening operation during which tangential air streams are jetted tangentially relative to the outer circumference of the yarn package 4 to effect loosening of a yarn end from the yarn package. Also, suction is applied through the lower yarn end engaging member 24 to draw the loosened yarn end into the suction opening 25 and along the lower yarn end engaging member 24.

The control unit 42 further implements the step 106 by controlling the timing camshaft to move through a predetermined angular movement as schematically illustrated by the arcuate arrow 47 in FIG. 4, and, in correspondence with this angular movement of the timing camshaft, the lower yarn end engaging member 24 is controlled to continue its counter-clockwise pivoting during which its suction opening 25 moves through the arc 33 shown in FIG. 1.

As the lower yarn engaging member 24 pivots between its yarn end engaging position and its cutting disposing position, as shown in FIG. 1, the lower yarn end which has been drawn into the engaging member is further unwound from the yarn package 4 and is ultimately disposed in the yarn cutting and clamping device 28 as the lower yarn end engaging member 24 reaches its cutting disposing position. The yarn is also disposed in the yarn cleaner 27 as well since the travel path of the yarn from the yarn package 4 toward the yarn cutting and disposing device 8 extends through the yarn cleaner.

The positioning of the lower yarn end engaging member 24 in its cutting disposing position occurs in correspondence with the completion of the movement of the timing camshaft through its angular movement 47. In correspondence with the completion of the angular movement 47 of the timing camshaft, which is schematically illustrated by the radial line segment 49 in FIG. 4, the control unit 42 performs an evaluation step 108, as schematically illustrated in FIG. 3*a*, to determine if the lower yarn end engaging member 24 has successfully engaged a lower yarn end.

The arrangement for detecting a successful engagement of a lower yarn end by the lower yarn end engaging member 24 can be any one of several arrangements. In one arrangement, the electronic yarn cleaner 27 can be adapted to provide a static yarn signal via the connector 27' to the control unit 42 which indicates that a lower yarn end has been disposed in the yarn cleaner 27 in connection with the disposing of the lower yarn end into the yarn cutting and clamping device 28. Since the yarn cutting and clamping device 28 is positioned immediately above the yarn cleaner 27 relative to the travel path of the yarn, the disposing of a lower yarn end in the yarn cutting and clamping device 28 such as illustrated in FIG. 1, correspondingly results in the lower yarn end also being disposed in the yarn cleaner 27.

The control unit 42 can be configured to query the yarn cleaner 27 concerning the presence of a lower yarn end therein. To prompt the control unit 42 to query the yarn cleaner 27, a contact assembly can be provided which includes one contact element mounted to the pivot of the lower yarn end engaging means 24 and a compatibly configured second contact element operatively connected via a connector 24' to the control unit 42. As the lower yarn end engaging member 24 pivots into its cutting disposing position shown in FIG. 1, the first contact element and the second contact element move into contact with one another and a corresponding signal is transmitted via the connector 24' to the control unit 42 to prompt the control unit to query the yarn cleaner 27 regarding the presence of a lower yarn end.

In another arrangement for detecting the presence of a lower yarn end in the lower yarn end engaging member 24, the lower yarn end engaging member 24 can be provided with a conventional sensor 45 having a conventional sensing configuration such as, for example, a photoelectric configuration, for sensing the presence of a lower yarn end at an interior location in the lower yarn end engaging member 24 upstream of the suction opening 25. The sensor 45 is connected to the control unit by a connector 45'.

If the control unit 42 determines during the evaluation step 108 that the lower yarn end engaging member 24 did not successfully engage a lower yarn end, the control unit 42 controls the lower yarn counting device to increment its count Z1 of lower yarn end engaging attempts by one, as schematically illustrated by the step 110 in FIG. 3*a*. The control unit 42 then compares the new increased value of the lower yarn end engaging attempts Z1 with a predetermined maximum attempt number n which can be, for example, preset at a value of 2, as schematically illustrated by the comparison step 112 in FIG. 3*a*.

If the count Z1 of the lower yarn end engaging attempts does not yet exceed the maximum attempt number n, the control unit 42, in a step 114 schematically illustrated in FIG. 3*a*, controls the timing camshaft to rotate in the direction opposite to its advancing direction in an angular movement 48', as shown in FIG. 4, during which angular movement the lower yarn end engaging member 24 is pivoted in a clockwise manner as viewed in FIG. 1 to move from its cutting disposing position to its yarn end engaging position in which its suction opening 25 is again disposed at the location 25'. Also, the chamber means 17 is again controlled to loosen a yarn end from the yarn package 4 in correspondence with this return pivoting of the lower yarn end engaging member 24. The timing camshaft then repeats its angular movement 47 and effects corresponding movement of the lower yarn end engaging member 24 from its yarn end engaging position to its cutting disposing position.

Each subsequent re-attempt to engage a lower yarn end is a repeat of the step 106 shown in FIG. 3*a* and the control unit 42 also re-executes the evaluation step 108 following each lower yarn engaging attempt to determine whether a lower yarn end has been successfully engaged by the lower yarn end engaging member 24. The control unit 42 controls the lower counting device to increment the count Z1 by a value of one in the step 110 each time that an attempt to engage a lower yarn end is unsuccessful. Additionally, the control unit 42 performs the evaluation step 112 following each incremental increase of the count Z1 to determine if the count Z1 equals or exceeds the maximum attempt number n.

In the event that the count Z1 equals or exceeds the maximum attempt number n, the control unit 42 implements a series of steps to effect an exchange of the yarn package 4 for the next yarn package 4 standing in a ready position on the endless belt 6 of the cross-transport assembly. In an evaluation step 116, as shown in FIG. 3*a*, the control unit 42 queries the ready position sensor 69 concerning the presence of a yarn package 4 supported at the ready position. If the ready position sensor 69 indicates that there is not a yarn package positioned at the ready position, the control unit 42 implements a step 118, shown in FIG. 3*a*, in which the timing camshaft remains at the end of its angular movement 47 as schematically represented by the radial line segment 49. The control unit 42 then repetitively executes an evaluation step 120, shown in FIG. 3*a*, during which the control unit 42 queries the ready position sensor 69 whether a yarn package is now positioned at the ready position. If a yarn package is still not positioned at the ready position, the control unit 42 repeats the query to the ready position sensor 69.

Ultimately, a tube support member 3 supporting a yarn package 4 is eventually transported by the endless belt 6 of the cross transport assembly into the ready position and the control unit 42 receives a corresponding signal from the ready position sensor 69 confirming the presence of a yarn package at the ready position. In response to this signal, the control unit 42 implements a step 122, as shown in FIG. 3*b*, to effect an exchange of the yarn package supported at the package winding location for the yarn package supported at the ready position. The package exchange step 122 is also implemented by the control unit 42 if the control unit 42 has determined, during the evaluation step 116, that a yarn package is in the ready position.

To implement the package exchange step 122, the control unit 42 controls the timing camshaft to rotate through an angular movement 50, schematically shown in FIG. 4. The angular movement 50 of the timing camshaft effects appropriate operation of the chamber means 17 to release the yarn package supported at the package winding location for further transport by the endless belt 6 beyond the package winding location and to effect movement of the yarn package at the ready position into the package winding location by the endless belt 6. At the completion 50' of the angular movement 50 of the timing camshaft, the chamber means 17 has received the yarn package previously positioned at the ready position and has closed the chamber halves around the yarn package in preparation for a yarn end loosening operation.

In correspondence with the completion 50' of the angular movement 50 of the timing camshaft, the control unit 42 implements a step 124, shown in FIG. 3*b*, to effect engagement of a lower yarn end of the fresh yarn package no positioned at the package winding location. The control unit 42 controls the timing camshaft to rotate through an angular movement 51, shown in FIG. 4, which causes the chamber means 17 to execute a yarn end loosening operation in response thereto in which tangential air streams are jetted against the outer circumference of the fresh yarn package and the lower yarn end engaging member 24 to apply a suction to engage a loosened yarn end which has travel upwardly beyond the chamber halves and to position the engaged yarn end in the yarn end cutting and clamping device 28.

At the completion 52 of the angular movement 51 of the timing camshaft, the control until 42 implements an evaluation step 126, shown in FIG. 3*b*, to determine whether the lower yarn end engaging member 24 has successfully engaged a lower yarn end of the fresh yarn package. In the event that the lower yarn end engaging member 24 has not successfully engaged a lower yarn end, the control unit 42 implements a step 128, shown in FIG. 3*b*, to effect rotation of the timing camshaft in its opposite rotation direction to return to its angular position indicated by the radial line segment 49 in preparation for a repetition of the evaluation step 116 during which the control unit 42 determines whether yet another yarn package is positioned at the ready position. If a further yarn package is positioned at the ready position, the control unit 42 repeats the package exchange step 122 to discharge the fresh yarn package from the package winding location and to move the further yarn package from the ready position to the package winding location. Thereafter, the control unit 42 repeats the step 124 to attempt to engage a lower yarn end of the further yarn package now positioned at the package winding location and the evaluation step 126 is also repeated to determine if the lower yarn engaging attempt has been successful.

Thus, the control unit 42 implements a single attempt with respect to each fresh yarn package supplied to the package winding location to engage a lower yarn end thereof. If the single lower yarn end engaging attempt is unsuccessful, the respective fresh yarn package is discharged from the package winding location and yet another fresh yarn package is supplied to the package winding location for a single attempt to engage a lower yarn end thereof. In one modification of the method of the present invention, the number of attempts to engage a lower yarn end of a respective yarn package can be set at a number other than 1 such as, for example, 2 or 3. Also, in one modification of the restoring apparatus, a conventional counting device can be operatively connected to the control unit 42 for counting the number of package exchange operations and the control unit 42 can be configured to initiate a predetermined stop operation in the event that a predetermined maximum number of package exchange operations have been performed without the successful engagement of a lower yarn end. The predetermined stop operation could include, for example, de-activation of the respective winding station and the activation of a indicating signal such as, for example, a red light at the respective winding station, to indicate that operator intervention may be required. The failure of a winding station to successfully engage a lower yarn end after a repeated number of package exchange operations may be caused, for example, by an operational problem with one of the tangential air jets 14–16 or the lower yarn end engaging member 24.

If the control unit 42 determines in the evaluation step 126 that a lower yarn end of a fresh yarn package has been successfully engaged, the control unit 42 implements a step 130, shown in FIG. 3*b*, to set the count Z2 of an upper yarn counting device (not shown) to a value of zero. The count Z2 represents the number of attempts to engage an upper yarn end of the cross-wound package 38. In correspondence with its implementation of the step 130, the control unit 42 controls the timing camshaft to rotate in its opposite rotation direction in an angular movement 53, shown in FIG. 4, to move the timing camshaft to an angular position indicated by the radial line segment 54 in FIG. 4.

The control unit 42 also implements the zero setting step 130 in response to a determination by the control unit during the evaluation step 102 that the yarn package at the package winding location (i.e.—the yarn package originally positioned at the package winding location at the time of the yarn break) does not have a sufficient amount of still remaining yarn to justify continuing the normal winding operation. In response to such a determination, the control unit 42 implements a yarn engaging step 132, schematically shown in FIG. 3*a*, to engage a lower yarn end of the yarn package at the package winding location. This procedure insures that the yarn on the yarn package will be completely unwound therefrom so that no subsequent operation such as, for example, a tube stripping operation, will be necessary to place the yarn package in a status in which only its empty tube 5 is supported on the respective tube support member 3. Moreover, this procedure for completely unwinding the still remaining yarn of a yarn package is particularly advantageous if the sensor 68 is not provided, but instead, the progress of winding is monitored by a conventional rotating wheel yarn length counting device. Since the total length of wound yarn on any particular yarn package may vary, a conventional rotating wheel yarn length counting device may not accurately indicate when a yarn package is completely unwound. However, the execution of the steps by the control unit 42 to insure that the still remaining yarn of a yarn package is completely unwound eliminates any risk that a yarn package may be prematurely discharged from the package winding location based upon an inaccurate indication from a conventional rotating wheel yarn length counting device that the package is completely unwound when, in fact, the yarn package is not yet fully unwound.

In correspondence with the movement of the lower yarn end engaging member 24 into its cutting disposing position in which it disposes a lower yarn end of the original yarn package into the yarn cutting and clamping device 28, the control unit 42 executes an evaluation step 134, shown in FIG. 3*a*, to determine whether the lower yarn end engaging member 24 has successfully engaged a lower yarn end of the original yarn package. If the control unit 42 determines that the lower yarn end has not been successfully engaged, the control unit implements the series of step beginning with the evaluation step 116 to effect an exchange of a fresh yarn package for the original yarn package. If the control unit 42 determines that the lower yarn end engaging member 24 has successfully engaged a lower yarn end of the original yarn package, the control unit 42 implements the zero setting step 130.

The control unit 42 also implements the zero setting step 130 if it determines, during its execution of the evaluation step 108, that a first or subsequent attempt to engage a lower yarn end of an original yarn package having a sufficient amount of still remaining yarn to justify further normal winding operations has been successfully engaged. As schematically illustrated in FIG. 3*a*, when the control unit 42 determines that a lower yarn end has been successfully engaged in such circumstances during the evaluation step 108, the control unit next proceeds to execute the zero setting step 130.

In one variation of the series of steps of the method representatively shown in FIGS. 3*a* and 3*b*, the control unit 42 can be configured to initiate a package exchange operation if a device for relatively precisely engaging the still remaining amount of yarn such as, for example, the sensor 68, indicates that the amount of still remaining yarn on the original package is relatively so small that unwinding of the still remaining yarn would not be productive.

After the zero setting step 130, the control unit 42 implements a step 136, shown in FIG. 3*b*, to effect engagement of an upper yarn end from the cross-wound package 38 by the upper yarn end engaging member 34. The control unit 42 controls the timing camshaft to move through an angular movement 55, as schematically shown in FIG. 4, during which angular movement the timing camshaft causes the upper yarn end engaging member 34 to move out of its normal lower position in which its suction head is in the location 34 prime as shown in FIG. 1, to its upper yarn engaging position in which its suction head is positioned adjacent the traversing feed drum 37 for applying suction to the cross-wound package 38. The application of a suction through the upper yarn end engaging member 34 is coordinated with the execution of the evaluation step 126 by the control unit 42 in such a manner that no suction is applied until the control unit 42 determines that a lower yarn end has been successfully disposed in the yarn cutting and clamping device 28.

In correspondence with the movement of the upper yarn end engaging number 34 to its upper yarn engaging position, the control unit 42 controls the traversing feed drum 37 to rotate in a direction opposite to its yarn feeding direction of rotation to effect corresponding rotation of the cross-wound package 38 in an unwinding direction. The unwinding rotation of the cross-wound package 38 facilitates the engagement of an upper yarn end thereof by the suction head of the upper yarn end engaging member 34.

After a predetermined period of time during which the suction head of the upper yarn end engaging member 34 is positioned adjacent a traversing feed drum 37 for engaging an upper yarn end, the control unit 42 controls the upper yarn end engaging member 34 to pivot in a clockwise direction as viewed in FIG. 1 to move its suction head through an arc 36 and ultimately return the suction head to the location 34'. If the upper yarn end engaging member 34 has successfully engaged in upper yarn end, the movement of the upper yarn end engaging member into its lower position effects the disposition of the engaged upper yarn end in the yarn cleaner 27 and the yarn cutting and clamping device 28, as illustrated in FIG. 2.

In correspondence with the completion of this return movement of the upper yarn end engaging member 34, the control 42 executes an evaluation step 138, shown in FIG. 3*b*. The upper yarn end engaging member 34 completes its return movement to its lower position in correspondence with the completion of the angular movement 55 of the timing camshaft, as schematically represented by the radial line segment 56 in FIG. 4. The timing of the evaluation step 138 can be controlled in response to a signal from an initiator means 44. The initiator means 44, which can be in the form, for example, of a contact device such as the contact device mounted on the lower yarn end engaging member 24, provides a signal via the connector 44' to the control unit 42 to indicate that the upper yarn end engaging member 34 is completing its return movement to its lower position For example, the initiator means 44 can include a contact element 34'', mounted on the upper yarn end engaging member 34 and pivotable in correspondence with the pivoting movement of the engaging member, and a compatibly configured contact element (not shown) for transmitting a signal in response to a contact by the contact element 34''. Alternatively, the completion of the movement of the upper yarn end engaging member 34 into its lower position can be monitored through detection of the movement of the timing camshaft.

In correspondence with the disposition of the upper yarn end in the yarn cleaner 27, the control unit 42 implements the evaluation step 138 by querying the yarn cleaner 27 concerning the presence of the upper yarn end therein. If the attempt by the upper yarn end engaging member 34 to engage an upper yarn end was unsuccessful, no upper yarn end will be present in the yarn cleaner 27. In this event, the control unit 42 increases the count Z2 of the number of attempts to engage an upper yarn end by a value of one, as schematically illustrated in the step 140 in FIG. 3*b*. The control unit 42 then performs a comparison step 142, schematically shown in FIG. 3*b*, in which it compares the incrementally increased value of the count Z2 with a predetermined maximum number of attempts n to engage an upper yarn end.

If the count Z2 equals or exceeds the maximum attempt number, the control unit 142 executes a step 144, shown schematically in FIG. 3*b*, in which the control unit 42 controls the timing camshaft to rotate in its opposite rotation direction through an angular movement 57, as shown in FIG. 4, to a restart position, as schematically shown by a radial line segment 58 in FIG. 4. Once the timing camshaft reaches the restart position represented by the radial line segment 58, the control unit 42 controls the timing camshaft to rotate in its normal rotation direction to repeat the attempt to engage an upper yarn end. In correspondence with this rotation of the timing camshaft, the upper yarn end engaging member 34 is pivoted out of its lower position to its upper yarn engaging position and suction is subsequently applied through its suction head to again attempt to engage an upper yarn end of the cross-wound package 38. The control 42 again performs the evaluation step 138 to determine if the subsequent attempt to engage an upper yarn end has been successful. After each determination that an attempt to engage an upper yarn end has not been successful, the control unit 42 increments the count Z2 in the step 140 and then compares the incremented value of the count Z2 to the maximum attempt number in the comparison step 142. In the event that the count Z2 of upper yarn end engaging attempts equals or exceeds the maximum count number n, the control unit 42 activates an appropriate signal means such as, for example, a red light 146, as schematically shown in FIG. 3*b* to indicate to an operator that there is a problem in engaging an upper yarn end.

The angular movement 57 of the timing camshaft to return to a restart position, such as the restart position represented by the radial line segment 58, can be shortened to a relatively smaller angular movement 57' which is completed when the timing camshaft reaches an alternate restart position represented by a radial line segment 58' as seen in FIG. 4. Both the restart position represented by the radial line segment 58 and the alternate restart position represented by the radial line segment 58' are angularly displaced from the angular position of the timing camshaft at which the upper yarn end engaging member is initially moved out of its lower position. Since the upper yarn end engaging member 34 reaches its upper yarn end engaging position before the timing camshaft has completed its angular movement to return its restart position and since the suction is applied through the upper yarn end engaging member 34 throughout the angular movement of the timing camshaft, the angular movement of the timing camshaft can be shortened to the angular movement 57' which ends generally in the middle of the opening phase of the suction applying through the upper yarn end engaging means 34.

The present invention also contemplates that the traversing feed drum 37 can be rotated in the direction opposite its feed direction during an upper yarn end engaging procedure at a relatively slower speed during subsequent attempts to engage an upper yarn end. Additionally, the present invention contemplates that the length of time during which a suction is applied through the suction head of the upper yarn end engaging member 34 can be lengthened as desired to correspondingly increase the chance that an upper yarn end will be successfully engaged by the upper yarn end engaging member 34.

If the control unit 42 determines during the evaluation step 138 that an upper yarn end has been successfully engaged and disposed in the yarn cutting and clamping device 28 and the yarn cleaner 27, the control unit 58 controls the timing camshaft to advance through an angular movement 59, as shown in FIG. 4, during which the yarn splicer 26 is controlled to perform a splicing operation 148, shown in FIG. 3*b*, in which the upper and lower yarn ends are spliced together.

Following the angular movement 59 of the timing camshaft, the control unit 42 controls the timing camshaft to move through an angular movement 60, as schematically represented in FIG. 4, during which the yarn splicer 26 is controlled to release the now-spliced yarn and to re-activate the traversing feed drum 37 to resume feeding of the yarn onto the cross-wound package 38. As the timing camshaft completes its angular movement 60, it returns to its initial 360° position and the control unit 42, in a step 150 as schematically shown in FIG. 3*b*, resumes its normal monitoring condition as the winding of yarn resumes following the yarn break. The normal monitoring activity of the control 42 includes receiving signals from the yarn cleaner 27 concerning any out of limit conditions which it may detect such as, for example, sections of the yarn traveling therethrough which are too thick or too thin.

As seen in FIG. 4, the time at which the timing camshaft completes its angular movement 51, during which it controls the lower yarn end engaging member 24 to engage a lower yarn end of a fresh yarn package, does not occur until after the timing camshaft has completed its angular movement 55 in which an upper yarn and is engaged by the upper yarn engaging member 34. This timing relationship is necessary because the upper yarn end engaging member 34 must be in its lower position before the lower yarn end engaging member 24 is pivoted in a counter-clockwise direction from its lower yarn engaging position to its cutting disposing position. Otherwise, since the splicing head of the upper yarn end engaging member 34 has a width substantially corresponding to the width of the traversing feed drum 37, the lower yarn end engaging member 24 may collide with the suction head of the upper yarn end engaging member 24 during the respective counter-clockwise pivoting movement of the lower yarn end engaging member 24 and the clockwise pivoting movement of the upper yarn end engaging member 34.

In one variation of the restoring apparatus, if a rotating wheel-type conventional yarn length counting device is provided, the device can be operatively interconnected to the traversing feed drum 37 so that the traversing drum 3 is controlled to already rotate in the direction opposite its feed direction to dispose an upper yarn end of the cross-wound package 38 in a ready position for engagement by the suction head of the upper yarn end engaging member 34 before the engaging member has fully pivoted to its upper yarn engaging position. This can reduce the possibly detrimental effects on the cross-wound package 38, especially if the package is built with relatively sensitive yarn, due to exposure to the suction action of the upper yarn end engaging member 34. Since the traversing feed drum 37 can dispose an upper yarn end in a ready position prior to the return of the upper yarn end engaging member 34 to its yarn engaging position, the length of time during which the cross-wound package 38 is exposed to the suction action is minimized.

In FIG. 5, another angular movement arrangement of the timing camshaft is schematically illustrated. As similarly discussed with respect to the angular movement arrangement of the timing camshaft illustrated in FIG. 4, the timing camshaft is rotated in an advancing rotation direction through the angular movement 61 and the angular movement 47 to effect the engagement of a lower yarn end. However, in the angular movement arrangement illustrated in FIG. 5, the times at which various events are initiated for effecting an exchange of a yarn package for a fresh yarn package occur relatively sooner than the same respective events initiated by the timing camshaft arrangement illustrated with respect to FIG. 4. The time at which a package exchange operation is initiated, schematically represented by a radial line segment 62' in FIG. 5, is sufficiently before the upper yarn end engaging member 34 has applied suction to the cross-wound package 38 in the upper yarn end engaging procedure (the procedure controlled in coordination with the movement of the timing camshaft through the angular movement 55) to enable a package exchange to be completed and a lower yarn end to be engaged and detected and placed in the yarn splicer 26 before an upper yarn end is disposed in the yarn cleaner 27. Since the lower yarn end has already been disposed in the yarn cleaner 27, its presence detected, and disposed in the yarn splicer 26 prior to the disposing of an upper yarn end in the yarn cleaner 27, the yarn cleaner 27 need only have the capability to distinguish between the presence or absence of a single yarn disposed therein without the need to have the capability for distinguishing between a single yarn and a pair of yarns.

In contrast, the timing camshaft arrangement illustrated in FIG. 4 requires a yarn cleaner 27 which has the capability to distinguish between the presence of a single yarn disposed therein and the presence of a pair of yarns disposed therein.

During the angular movement 62 of the timing camshaft, the package exchange is accomplished and, thereafter, during an angular movement of the timing camshaft schematically represented by the arc 64 in FIG. 5, the presence of a lower yarn end in the yarn cleaner 27 is determined. If at the end 65 of the lower yarn end determining step, it is determined that no lower yarn end is present in the yarn cleaner 27, the timing camshaft is rotated in the direction opposite its advancing rotation through an angular movement 66, shown in FIG. 5, to a predetermined angular position schematically represented by a radial line segment 67 in FIG. 5.

As the timing camshaft moves through its angular movement 66, it passes the angular position 63 which is the angular position at which the package exchange angular movement 62 is completed. Through an appropriate coupling such as, for example, a magnetically activatable catch mechanism, the rotation of the timing camshaft past the angular position 63 during the return angular movement 66 can initiate a package exchange operation in which the yarn package currently at the package winding location is exchanged for yet another yarn package. Accordingly, as the timing camshaft completes its angular movement 66 as it reaches the angular position 67 and thereafter reverses its rotation to angularly move back toward the angular position 63, the package exchange operation will be fully completed by the time the timing camshaft again passes the angular position 63. The immediately following angular movement 64 of the timing camshaft causes the lower yarn end engaging member 24 to be moved as previously discussed so as to engage a lower yarn end of the fresh yarn package which has just been moved into the package winding location.

In FIG. 6, yet another angular movement arrangement of the timing camshaft is schematically illustrated. This angular movement is suitable for use with a configuration of the restoring apparatus which includes a lower yarn end sensor mounted directly to the lower yarn end engaging means 24 such as, for example, the sensor 45. In this arrangement the timing camshaft controls the operation of the chamber means 17 and the lower yarn end engaging member 24 to effect engagement of a lower yarn end during the angular movement 47', which corresponds to the angular movement 47 schematically illustrated in FIG. 4. The angular movement 47' is relatively smaller than the angular movement 47 since the sensor 45 mounted on the lower yarn end engaging member 24 enables the control unit 42 to determine if a lower yarn end has been successfully engaged relatively shortly after the lower yarn end engaging member 24 has begun to apply suction above the chamber halves while, in contrast, when the lower yarn end engaging member 24 is controlled by the timing camshaft arrangement in FIG. 4, it must first reach its upper cutting disposing position in which the lower yarn end is disposed in the yarn cleaner 27 before the control unit 42 can determine the success of the lower yarn end engaging operation.

A restoring apparatus of the present invention thus permits, as illustrated by the three exemplary arrangements discussed with respect to FIGS. 4–6, a virtually infinite flexibility in the timing of the operations of the various components which perform the yarn end loosening operation, the yarn end engaging operation and the yarn end splicing operation. Accordingly, individual steps and, especially, repetitive steps, can be eliminated so that the risk of damage to the cross-wound package and/or the supply yarn package can be minimized. This is especially useful in situations in which a relatively sensitive yarn such as, for example, core spun yarn, is being wound. Since the restoring apparatus of the present invention initially attempts to engage a lower yarn end before attempting to engage an upper yarn end from the cross-wound package, unnecessary upper yarn end engaging attempts are avoided if it is determined that a lower yarn end has not been successfully engaged. Moreover, this timing relationship permits the flexibility to limit the number of attempts to engage an upper yarn end to a single attempt, thereby correspondingly preventing the repetition of the relatively time-consuming movements of the upper yarn end engaging member.

The restoring apparatus of the present invention advantageously makes use of the time during which the cross-wound package slows to a standstill following the cessation of winding due to a yarn break. Typically, the cross-wound package takes a relatively long period of time to come to a standstill following a yarn break. During this period of time, the timing camshaft is executing its angular movement 47 during which it controls the lower yarn end engaging member 24 to attempt to engage a lower yarn end. The rotation of the cross-wound package typically is still continuing at the time, schematically represented by the radial line 7 at 49, at which the lower yarn end engaging member 24 is completing its first lower yarn end engaging attempt. Since the restoring apparatus only attempts to engage an upper yarn end from the cross-wound package after one or more attempts have been completed to engage a lower yarn end, the restoring apparatus does not remain idle during the period of time immediately following a yarn break during which the cross-wound package gradually comes to a standstill.

The restoring apparatus additionally provides the advantage that a complete yarn restoring operation does not have to be executed each time it is determined that a lower yarn end has not been successfully engaged from a respective fresh supply package supplied to the package winding location. Instead, the restoring apparatus of the present invention simply executes a package exchange operation without unnecessary movements of the upper yarn end engaging member 34 or the lower yarn end engaging member 24.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile winding process in which yarn is wound from a supply package onto another package, a method for restoring the normal winding of yarn following a yarn break of the type which creates an upper yarn end on the package being wound due to an interruption in the yarn traveling from the supply package to the package being wound, comprising:

executing a lower yarn end engaging cycle which includes performing at least one attempt to engage a lower yarn end from the supply package and detecting the presence or absence of engagement of a lower yarn end after said performing an attempt;

exchanging the supply package for a new supply package in response to the detection of the absence of a lower yarn end after a predetermined number of said attempts to engage said lower yarn end;

repeating said executing cycle and said exchanging the supply package until a selected one of the detection of a lower yarn end or the completion of a predetermined number of repetitions has occurred;

executing an upper yarn end engaging cycle, in response to said detecting the presence of engagement of a lower yarn end, which includes performing an attempt to engage an upper yarn end from the package being wound and detecting the presence or absence of engagement of an upper yarn end after said performing an attempt; and performing a yarn joining cycle, in response to said detecting the presence of engagement of a lower yarn end, in which the detected upper yarn end and the detected lower yarn end are joined together.

2. In a textile winding process, the method according to claim 1 and characterized further by repeating said performing an attempt to engage an upper yarn end until a selected one of the detection of an upper yarn end or the completion of a predetermined number of repetitions has occurred and stopping the restoring of the normal winding of yarn if said predetermined number of repetitions of said performing an attempt to engage an upper yarn end has been completed.

3. In a textile winding machine having a winding station for winding yarn from a supply package onto another package, an apparatus for restoring the normal winding of yarn following a yarn break of the type which creates an upper yarn end on the package being wound due to an interruption in the yarn traveling from the supply package to the package being wound, comprising:

means for engaging a lower yarn end from the supply package, said lower yarn end engaging means being movable between a lower yarn end engaging position in which it is operable to engage a lower yarn end of a supply package and a lower yarn end positioning location in which it positions a lower yarn end for detection at a detection location;

means for engaging an upper yarn end from the package being wound, said upper yarn end engaging means being movable between an upper yarn end engaging position in which it is operable to engage an upper yarn end from the package being wound and an upper yarn end positioning location in which it positions an upper yarn end for detection;

means for exchanging a supply package for a fresh supply package;

means for detecting the presence or absence of a yarn end at said detection location, said detecting means being operable to selectively detect the presence or absence of a lower yarn end at said detection location in correspondence with the movement of said lower yarn end engaging means into said lower yarn end positioning location and being operable to selectively detect the presence or absence of an upper yarn end at said detection location; and means for controlling said exchanging means and said lower yarn end engaging means to perform a predetermined number of lower yarn end positioning cycles, each cycle including the operation of said exchanging means to perform an exchange operation in response to the detection by said detecting means of the absence of a lower yarn end at said detection location after said lower yarn end engaging means has completed a predetermined number of lower yarn end engaging operations and the operation of said lower yarn end engaging means to perform a predetermined number of lower yarn end engaging operations on each supply package following each said exchange operation.

4. In a textile winding machine, the restoring apparatus according to claim 3 and characterized further in that said controlling means includes means for controlling said upper yarn end engaging means to execute a predetermined number of upper yarn engaging operations in response to the detection by said detecting means of a lower yarn end and a lower yarn end counting device for counting the number of lower yarn end engaging operations, said lower yarn end counting device being operable to count a predetermined number of lower yarn end engaging operations.

5. In a textile winding machine, the restoring apparatus according to claim 3 and characterized further by chamber means for selectively surrounding at least a portion of the supply package, said chamber means including means for directing streams of air tangentially against the outer surface of a supply package to facilitate the loosening of a yarn end therefrom.

6. In a textile winding machine, the restoring apparatus according to claim 5 and characterized further in that said controlling means includes means for controlling the operation of said air stream in coordination with the movement of said lower yarn end engaging means, said air stream controlling means being operable to stop said air stream in response to movement of said lower yarn end engaging means from said lower yarn end engaging position toward said lower yarn end detection location.

7. In a textile winding machine, the restoring apparatus according to claim 6 and characterized further in that said air stream controlling means includes means for activating said air stream in response to the movement of said lower yarn end engaging means into said lower yarn end engaging position.

8. In a textile winding machine, the restoring apparatus according to claim 7 and characterized further in that said air stream controlling means includes means for controlling said air streams to operate during a subsequent attempt to loosen a yarn end for a relatively longer period of time than the period of time during which said air streams are directed against the package during an initial attempt to loosen a yarn end therefrom.

9. In a textile winding machine, the restoring apparatus according to claim 3 and characterized further by means for determining the presence or absence of a predetermined minimum remaining amount of yarn on a supply package, said controlling means controlling said exchanging means to exchange the respective supply package for a fresh supply package in response to a determination by said remaining yarn amount determining means that the respective supply package has less than said predetermined minimum remaining amount of yarn.

10. In a textile winding machine, the restoring apparatus according to claim 9 and characterized further in that said remaining yarn determining means includes a photoelectric sensor.

11. In a textile winding machine, the restoring apparatus according to claim 3 and characterized further in that said controlling means includes means for measuring the length of yarn traveling from the supply package and the package being wound, said controlling means being operable to determine the remaining amount of yarn on a supply package based upon information received from said measuring means.

12. In a textile winding machine, the restoring apparatus according to claim 3 and characterized further by ready position sensing means for sensing the presence of a fresh supply package at a ready position in which fresh supply packages are held immediately before they are supplied to the winding station in an exchange operation and said controlling means is operable to prevent said exchanging means from performing an exchange operation during one of said lower yarn end positioning cycles in response to sensing by said ready position sensing means that no fresh supply package is present at said ready position.

13. In a textile winding machine, the restoring apparatus according to claim 3 and characterized further in that said controlling means includes a plurality of timing cams, commonly mounted on a timing camshaft, said timing camshaft being rotatable in an advancing direction through a predetermined angular movement to control said exchanging means and said lower yarn end engaging means to perform said predetermined number of lower yarn end positioning cycles, said timing camshaft being rotatable in a direction opposite to said advancing direction through a predetermined angular movement in response to the detecting by said detecting means of the absence of a lower yarn end at said detection location, said predetermined angular movement of said timing camshaft in said opposite direction being selected to return said timing camshaft to a predetermined angular position corresponding to the beginning of the predetermined angular movement of said timing camshaft during which said timing camshaft controls said exchanging means to perform an exchange operation.

14. In a textile winding machine, the restoring apparatus according to claim 13 and characterized further by means for indicating that a problem has occurred in a restoring operation, means for determining movement of said upper yarn end engaging means into said upper yarn end detection location, said upper yarn end movement determining means being operatively connected to said controlling means, and means for counting the number of attempts by said upper yarn end engaging means to engage an upper yarn end, said upper yarn end engaging attempts counting means being operatively connected to said controlling means and said controlling means being operable to move said timing camshaft in said opposite direction through a predetermined angular movement in response to a signal from said upper yarn end movement determining means indicating that said upper yarn engaging means has moved into said upper yarn end positioning location in correspondence with a signal from said detecting means indicating the absence of an upper yarn end, said controlling means controlling said timing camshaft to return to a predetermined angular position corresponding to the beginning of the angular movement of said timing camshaft during normal winding of yarn and to activate said problem indicating means in response to the counting by said upper yarn end engaging attempts counting means that a predetermined number of upper yarn end engaging operations have been completed without the detecting by said detection means of an upper yarn end at said detection location.

15. In a textile winding machine, the restoring apparatus according to claim 14 and characterized further in that said controlling means includes means for controlling said upper yarn end engaging means to remain at said upper yarn end engaging position for a relatively longer period of time during subsequent upper yarn end engaging attempts than during the initial upper yarn end engaging attempt.

16. In a textile winding machine, the restoring apparatus according to claim 3 and characterized further in that said controlling means includes a timing apparatus having a plurality of timing cams, each individually associated with a respective component of the restoring apparatus, and a timing camshaft on which said timing cams are commonly mounted.

17. In a textile winding machine, the restoring apparatus according to claim 16 and characterized further in that said controlling means includes means for controlling said timing camshaft to rotate relatively slower through its particular angular movement during control of said upper yarn engaging means to engage an upper yarn end in subsequent upper yarn end engaging attempts in comparison to the rate of rotational movement of said timing camshaft through its predetermined angular movement during which said upper yarn end engaging means is controlled to engage an upper yarn end in an initial upper yarn end engaging attempt.

18. In a textile winding machine, the restoring apparatus according to claim 3 and characterized further in that said controlling means includes means for controlling the rotation of the cross-wound package to effect rotation of the package being wound in a direction opposite to its rotating direction at a relatively slower rotational speed during an upper yarn end engaging operation than the rotational speed of the package being wound during normal winding operation.

* * * * *